United States Patent [19]

Yamashita

[11] 4,364,051

[45] Dec. 14, 1982

[54] MOBILE ANTENNA MOUNTING ASSEMBLY WITH RESILIENT LOCKING MEANS

[75] Inventor: Koji Yamashita, Tokyo, Japan

[73] Assignee: Nippon Electric Co., Ltd., Tokyo, Japan

[21] Appl. No.: 195,307

[22] Filed: Oct. 8, 1980

[30] Foreign Application Priority Data

Oct. 11, 1979 [JP] Japan ..... 54-140590[U]

[51] Int. Cl.[3] ..... H01Q 1/32

[52] U.S. Cl. ..... 343/715; 343/880

[58] Field of Search ..... 343/711-715, 343/900, 880, 882

[56] References Cited

U.S. PATENT DOCUMENTS 3,249,945 5/1966 Lewis ..... 343/749

4,190,839 2/1980 Liautand ..... 343/715

4,242,684 12/1980 Wolverton ..... 343/715

*Primary Examiner*—David K. Moore

*Attorney, Agent, or Firm*—Laff, Whitesel, Conte & Saret

[57] ABSTRACT

A mobile antenna mounting assembly has a first coaxial connector fixed on a body panel of an automobile and a second coaxial connector fixed on the end portion of an antenna element to be connected with the first connector. An elliptic flange is attached on the base of the first coaxial connector. A cap is slidably mounted in the axial direction along the second coaxial connector in order to cover the second coaxial connector. A groove is formed on the inner circumference of the second connector to facilitate an engagement between the groove and the flange when the first and second coaxial connectors are connected to each other.

7 Claims, 4 Drawing Figures

MOBILE ANTENNA MOUNTING ASSEMBLY WITH RESILIENT LOCKING MEANS

The present invention relates to a mounting assembly for a mobile antenna which is mounted on a motor vehicle.

A sleeve antenna is generally used for high-frequency communications, such as an automobile telephone system. Such a sleeve antenna is fixedly carried on the body of a motor vehicle and is usually attached and/or detached by using coaxial connectors of a screw-in type. For preventing the antenna from becoming loosened by vibrations due to the running of the motor vehicle or for securing the screw-in connection, the antenna is usually fixed in place by the setscrew of hexagon socket, headless type. This has caused inconveniences, however, as when washing the vehicle in an automatic car washer. The setscrew has to be unfastened and the user of the vehicle always has to carry necessary tools therefor. Further, when a vehicle is driven into or out of a garage, the antenna sometimes has to be repeatedly detached from or attached to the auto body, again presenting inconveniences.

In order to obviate such inconveniences and annoyances, connecting assemblies have used a tab and a plate in the coaxial connector means to easily detach the antenna from the auto body by twisting the coaxial connector on the radiating element side of the antenna. Reference is made to U.S. Pat. No. 4,173,761. The antenna assembly of this type is easily detachable, it is often stolen, and the structure is complicated.

An object of the present invention is to provide a mobile antenna assembly which is removable, without requiring any tools and which can be securely fixed to the automobile body.

Another object of the present invention is to provide a locking means for a mobile antenna, wherein the locking means has a simple structure, with a certain burglar-proof means.

According to the present invention, a mobile antenna mounting assembly has a first coaxial connector fixed on a body panel of an automobile. A second coaxial connector is fixed on the end of an antenna element and arranged to be connected with the first connector. An elliptic flange is provided on the base of the first coaxial connector, and a cap is axially slidably along the second coaxial connector in order to cover it. A groove is formed on the inner circumference of the cap to facilitate an engagement between the groove and the flange when the first and second coaxial connectors are connected to each other.

The features and advantages of the present invention will now be apparent from the detailed description hereunder taken in conjunction with drawings, wherein.

Figure 1:
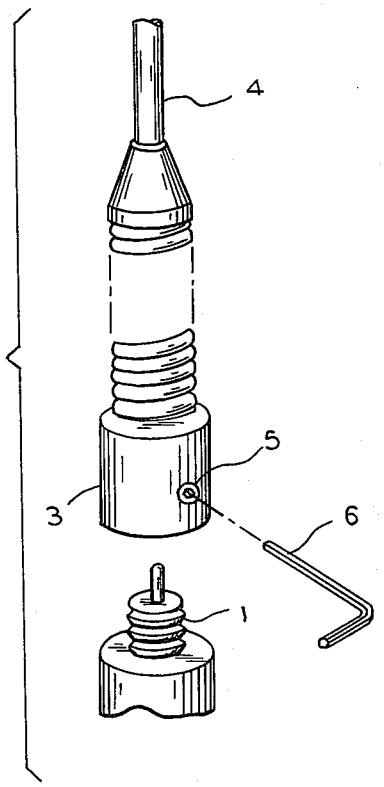
FIG. 1 is an exploded perspective view of the locking means and mounting tool for a conventional mobile antenna mounting assembly.

In FIG. 1, an antenna element 4 is mounted by the connection made between screw-in coaxial connectors 1 and 3 and is securely fixed in position by a hexagon socket, headless setscrew 5. The antenna element 4 is detached by releasing the setscrew 5 by means of an allen wrench or hexagon L bar wrench 6. As described above, attaching and detaching of the antenna element presents inconveniences and complications.

Figure 2:
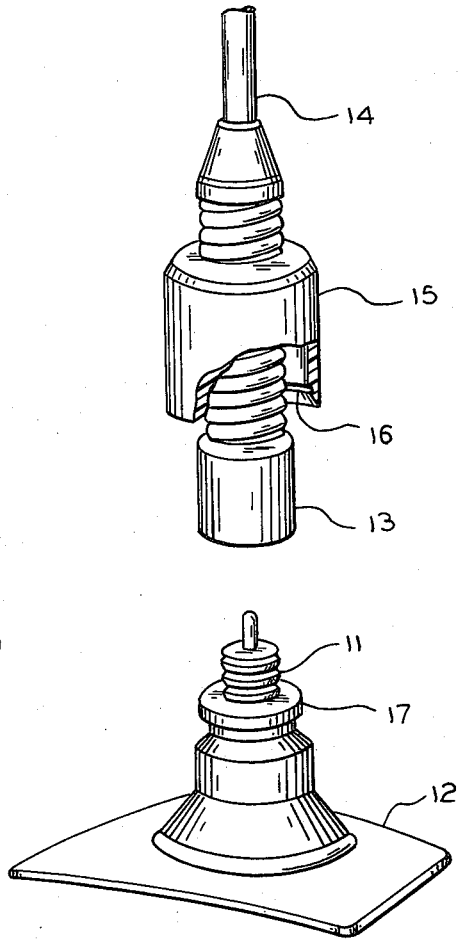
FIG. 2 is an exploded perspective view of an antenna mounting assembly according to the present invention.

In FIG. 2, a cap 15 is constructed to cover the coaxial connector 11 fixed on the side of the body plate 12 and the coaxial connector 13 fixed on the end of the antenna element 14, when both are mutually connected. A flange 17, of elliptic form, is provided on the base of the coaxial connector 11.

Figure 3:
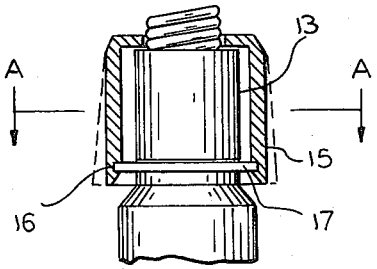
FIG. 3 is a partial cross sectional view showing the main structure of FIG. 2 in order to explain how the cap is connected.

The locking of this invention is effected in the following manner; after connecting the coaxial connectors 11 and 13 to each other. The cap 15 is slidably depressed from above on the flange 17 to be deformed so that it conforms with the elliptic shape of the flange as shown by the two-dot dashed line in FIG. 3. When the cap 15 is further pressed, the flange 17 becomes finally and fixedly engaged in a groove 16, provided on the inner circumference of the cap 15.

Figure 4:
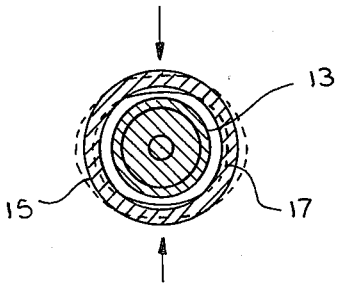
FIG. 4 is a cross sectional, partially perspective, view, taken along line A—A of FIG. 3.

When the antenna element 14 is to be released, the cap 15 is pressed or squeezed from the two opposing directions shown by arrows in FIG. 4. When cap 15 is sufficiently deformed, the flange 17 come off the groove 16. Then, the cap 15 is moved upwardly and detached from the connector assembly. The coaxial connector 13 can then be disconnected by lifting it from the other connector 11.

The cap 15 may be made of a resilient material such as plastics. In the embodiment shown here, it is made with DELRIN (brand name) available from Du Pont de Nemours and Company.

The present invention is advantageous in that the connecting condition can be clearly confirmed. Due to the preferable structure, as described above, the flange can not be engaged with the groove of the cap unless the coaxial connectors are completely connected to each other. The cap prevents the coaxial connectors from becoming disconnected from each other due to looseness in the screw-in connection. The present invention is further advantageous in that the locking means is of an extremely simple structure and in that the unlocking operation thereof can readily be accomplished with bare hands. Therefore, when the vehicle is sent through an automatic washing process or when the vehicle is placed in a garage, it takes little time and trouble to disconnect the antenna from the motor vehicle.

The present invention is further expedient since the cap is freely rotatable when engaged in the groove of the flange, and it is simple for those who know the operation to handle it. Yet it is not obvious for those who are not familar with such an operation. In other words, being a circular-shaped member, it appears readily rotatable and, thereby it prevents mischiefs and petty theft.

What is claimed is:

1. A mobile antenna mounting assembly comprising a first coaxial connector fixed on a body panel of an automobile and a second coaxial connector fixed on the end of an antenna element to be connected with said first connector, an elliptic flange having a major axis and a minor axis of cross-section, said flange being formed on the base of said first coaxial connector; a resilient cap slidably mounted in the axial direction along said second coaxial connector to cover or uncover it, said cap having a groove on the inner circumference thereof to facilitate an engagement of said groove with said flange when said first and second coaxial connectors are connected to each other, said cap being released by squeezing it together on opposing sides of the minor axis of said elliptic flange.

2. A quick connect/disconnect connector for use in a signal transmission path of electronic equipment, said connector comprising first and second coaxial connector halves for interconnecting conductors forming said transmission path, one of said connector halves having formed thereon an outwardly extending elliptical flange having a major axis and a minor axis, the other of said connector halves having an associated sliding resilient cap with a groove formed therein, said cap sliding into a position which mates with said elliptical flange, said sliding cap deforming to capture or release said elliptical flange in said groove when said cap is slid over coupled connector halves, said groove being released from said flange when it is pressed on opposing sides of the minor axis of said elliptical flange.

3. The connector of claim 2 wherein said cap freely rotates on said flange when captured thereon.

4. The connector of claim 1 or 2 wherein said cap is made of plastic material.

5. The connector of claim 1 or 2 wherein the geometry of said connector halves and cap is such that the groove in said cap cannot capture said flange unless said coaxial connectors are fully interconnected.

6. The connector of claim 5 wherein said cap prevents said interconnected connectors from becoming disengaged when said cap is in place.

7. The connector of claim 1 or 2 wherein the external contours of said cap contains no visible means of locking or way of detaching.

* * * * *